US011879697B2

(12) United States Patent
Magee et al.

(10) Patent No.: US 11,879,697 B2
(45) Date of Patent: Jan. 23, 2024

(54) FIREARM MUZZLE ATTACHMENT APPARATUS

(71) Applicant: Sound Moderation Technologies, LLC, Raleigh, NC (US)

(72) Inventors: Todd A. Magee, Farmington, UT (US); Steven M. Pappas, Kamas, UT (US)

(73) Assignee: Sound Moderation Technologies, LLC, Raleigh, NC (US)

( * ) Notice: Subject to any disclaimer, the term of this patent is extended or adjusted under 35 U.S.C. 154(b) by 0 days.

(21) Appl. No.: 17/942,727

(22) Filed: Sep. 12, 2022

(65) Prior Publication Data

US 2023/0168057 A1 Jun. 1, 2023

Related U.S. Application Data

(63) Continuation of application No. 14/999,067, filed on Mar. 25, 2016, now Pat. No. 11,441,867.

(51) Int. Cl.
*F41A 21/30* (2006.01)

(52) U.S. Cl.
CPC ..... *F41A 21/30* (2013.01)

(58) Field of Classification Search
CPC ..... F41A 21/30–42
USPC ..... 89/14.2–14.4; 181/223
See application file for complete search history.

(56) References Cited

U.S. PATENT DOCUMENTS 968,583 A * 8/1910 Michaud ..... F41A 21/40 42/79
2,466,400 A * 4/1949 Ennis ..... F41A 21/40 89/14.05
4,510,843 A * 4/1985 Rabatin ..... F41A 21/325 89/14.4
7,516,690 B2 * 4/2009 McClellan ..... F41A 21/34 89/14.3
8,342,071 B2 * 1/2013 Hortobagyi ..... F41A 21/34 89/14.3
8,714,300 B2 * 5/2014 Johansen ..... F41A 21/30 89/14.4
8,997,621 B1 * 4/2015 Dater ..... F41A 21/325 89/14.3
9,121,656 B1 * 9/2015 McKenzie ..... F41A 21/30
9,175,919 B2 * 11/2015 Russell ..... F41A 21/30
9,377,263 B1 * 6/2016 Sy ..... F41A 21/325
9,513,078 B1 * 12/2016 Fulton ..... F41A 21/325
(Continued)

*Primary Examiner* — Joshua E Freeman
*Assistant Examiner* — Benjamin S Gomberg
(74) *Attorney, Agent, or Firm* — Charmasson, Buchaca & Leach, LLP

(57) ABSTRACT

A mount for mounting a firearm sound suppressor or silencer to a firearm muzzle or muzzle device operates by using primary mounting lugs on the suppressor which engage sockets on the muzzle device. The primary lugs prevent the suppressor from axially moving with respect to the muzzle device, thus causing them to be fixed together as a unitary device. Angled bearing faces on the muzzle device and the sound suppressor are pressed against each other by rotating the sound suppressor on threads which drive the angled bearing faces together, thus tightening the primary lugs within their sockets. Backup lugs on the silencer engage an annular groove on the muzzle device to retain the silencer on the firearm to which it is mounted in case of failure of the primary lugs. Rapid attachment and detachment are supported by these structures.

9 Claims, 17 Drawing Sheets

(56) References Cited

U.S. PATENT DOCUMENTS

| | | | | |
|---|---|---|---|---|
| 9,631,888 | B2 * | 4/2017 | Young | F41A 21/325 |
| 9,739,560 | B1 * | 8/2017 | Salvador | F41A 21/32 |
| 9,970,727 | B2 * | 5/2018 | Niswander | F41A 21/34 |
| 10,215,318 | B2 * | 2/2019 | Gaspar | F16L 33/2073 |
| 10,458,738 | B2 * | 10/2019 | Albino | F41A 21/30 |
| 10,641,573 | B2 * | 5/2020 | Jen | F41A 21/325 |
| 10,670,362 | B2 * | 6/2020 | Wilson | F41A 21/36 |
| 10,753,700 | B2 * | 8/2020 | Wolf | F41A 21/325 |
| 10,767,952 | B1 * | 9/2020 | Till | F41A 21/325 |
| 10,890,402 | B2 * | 1/2021 | Orne | F41A 21/325 |
| 11,441,867 | B2 * | 9/2022 | Magee | F41A 21/30 |
| 2009/0193963 | A1 * | 8/2009 | Poulsen | F41A 21/30 89/14.4 |
| 2011/0197487 | A1 * | 8/2011 | Humston | F41A 21/34 42/1.06 |
| 2013/0180150 | A1 * | 7/2013 | Dueck | F41A 21/34 29/428 |
| 2014/0237881 | A1 * | 8/2014 | Mack | F41A 21/325 42/90 |
| 2018/0299223 | A1 * | 10/2018 | Barrett | F41A 21/30 |
| 2020/0096280 | A1 * | 3/2020 | Graham, II | F41A 21/30 |
| 2021/0389074 | A1 * | 12/2021 | Reis-Green | F41A 21/325 |

* cited by examiner

FIREARM MUZZLE ATTACHMENT APPARATUS

PRIOR APPLICATION

This application is a continuation of U.S. patent application Ser. No. 14/999,067, filed 2016 Mar. 25, soon to be U.S. patent Ser. No. 11/441,867, issuing 2022 Sep. 13, incorporated herein by reference.

BACKGROUND

A. Field of the Invention

For many years after sound suppressors for firearms were first developed, the sound suppressors were attached to firearm barrels by use of threads on the muzzle portion of the firearm barrel. Threads on the exterior of the firearm muzzle mated with threads on the interior of a sound suppressor, and the user of the firearm could install the sound suppressor by screwing it onto the firearm barrel.

Such an arrangement was unsatisfactory in many regards. Attaching a sound suppressor to a firearm took excessive time and effort. During use, the sound suppressor could rattle loose. The threads could become damaged and it would not be possible to install the sound suppressor. And use of a sound suppressor meant it was not possible to also use a flash hider, muzzle brake or other muzzle device on the same firearm.

As used herein, the terms "sound suppressor", "suppressor" and "silencer" have the same meaning and are interchangeable, and should be interpreted to be a device attached to or attachable to a firearm which reduces the audible report of the firearm when it is used to discharge ammunition. Silencers are to be contrasted with "flash suppressors" or "flash hiders" which are designed to reduce the amount of muzzle flash that a firearm creates when it is fired, and silencers should be contrasted with "muzzle brakes" which redirect expanding gases from the discharge of ammunition in a firearm in order to reduce muzzle rise or recoil. The term "muzzle device" used herein refers collectively to flash suppressors, flash hiders and muzzle brakes which may be attached to the muzzle end of a firearm barrel, or which may be formed into the muzzle end of a firearm barrel.

B. Description of Related Art

The industry has address the problems in the prior art with several types of sound suppressor attachment arrangements.

U.S. Pat. No. 5,559,302 entitled "Bayonet Type Coupling for Firearms" which issued on Sep. 24, 1996 to inventor Gregory S. Latka discloses a spring-loaded mount for attaching a sound suppressor or other accessory to a firearm muzzle. The mount utilizes three (3) lugs located on the muzzle end of the firearm barrel. This is the type of sound suppressor mounting system commonly seen on HK MP5 submachine guns.

U.S. Pat. No. 4,893,426 entitled "Lugged Coupling Apparatus" which issued on Jan. 16, 1990 to inventor Timothy D. Bixler discloses a sound suppressor mount which uses three (3) lugs located on the muzzle end of a firearm barrel.

U.S. Pat. No. 8,091,462 entitled "Firearm Attachment Locking System" which issued on Jan. 10, 2012 to inventors Barry W. Dueck and Karl Honigmann discloses a firearm sound suppressor mount that affixes to a firearm barrel by using a radially-rotatable lock ring which is secured in place by a lever that presses against indentations in the lock ring.

U.S. Pat. No. 7,946,069 entitled "Systems for Attaching a Noise Suppressor to a Firearm" which issued on May 24, 2011 to inventors Barry W. Dueck, John W. Matthews and Brooke C. Smith discloses a firearm sound suppressor mount that rotatably locks a sound suppressor to a firearm muzzle using an eccentric nut and ratchet mechanism.

United States Patent Application Publication No. 2010/0229712 entitled "Muzzle Attachment System" filed by inventor James J. Graham and which was published on Sep. 16, 2010 discloses a sound suppressor mount that uses a wave washer/detent on the muzzle end of a firearm barrel combined with indentations on the end of the sound suppressor that attaches to the rifle barrel.

U.S. Pat. No. 8,794,376 entitled "Firearm Flash Suppressor System" which issued on Aug. 5, 2014 to inventors Jonathan Shults, Harrison Holden and Casey Brandol discloses a sound suppressor mount that uses cams and pins to secure a sound suppressor to the muzzle end of a firearm barrel. This system has proven to be unreliable because the cams can fail to secure the sound suppressor to a firearm barrel, and when ammunition is shot through the firearm barrel, expanding gases from the discharged ammunition cause the sound suppressor to disengage from the firearm barrel and travel downrange as a secondary projectile. Such a situation can result in user dissatisfaction as well as physical danger.

Notwithstanding prior art attempts to solve the problems associated with attaching a sound suppressor to a firearm, the existing solutions remain cumbersome, inconvenient, unreliable, fragile and/or expensive, showing a clear need for a viable silencer mount which serves the function of permitting a silencer to be releaseably mounted to the muzzle end of a firearm barrel and detached from the firearm barrel at will, preferably in conjunction with the use of a muzzle device on the muzzle end of the firearm barrel.

SUMMARY

A novel and useful mount for attaching a silencer to the muzzle end of a firearm barrel has been invented.

It appears that the first successful firearm silencer or sound suppressor was invented by Hiram Percy Maxim, son of the great machine gun inventor Hiram Stevens Maxim. The Maxim firearm sound suppressor was patented on Mar. 30, 1909 as U.S. Pat. No. 916,885 under the title "Silent Firearm". The Maxim silencer used a tube and a series of baffles to constrain expanding gases emitted by the discharge of ammunition in a firearm in order to reduce the sound or report caused by shooting the firearm.

In reality, a silencer or sound suppressor does not cause a firearm to be silent. Instead, it reduces the sound emitted by the firearm when it is shot by causing expanding gases that are released by burning gun powder to pass through a series of baffles within a confined cavity of the silencer. The speed of the expanding gases will be reduced by the silencer, and some of the energy of the expanding gases will be dissipated within the silencer, resulting in a lessened report when those gases exit the silencer compared to if those expanding gases had not been forced to travel through the silencer.

A lessened report from shooting a firearm is advantageous in many situations. In training or practicing with firearms, both the shooter and persons nearby a firearm that is being shot can suffer hearing loss, even when hearing protection is worn. The shooter and persons nearby can also find the loud report of some firearms, particularly short-barreled firearms, to be unpleasant. It is also an advantage in a military situation to conceal one's location when shooting a firearm in order to avoid attracting the attention of enemy troops. In a police situation, persons nearby can become alarmed or panicked as a result of hearing unexpected gunshots, leading them to experience stress and/or to flee the area in a manner that creates new dangers to themselves and to others. And in a hunting or pest control situation, the report of a firearm being discharged typically frightens game and pests alike, and can reduce the opportunity for the quarry to be bagged.

As noted in the BACKGROUND section above, it is desirable to provide for a silencer to be attached to a firearm by means other than simple threads on the end of the firearm barrel. A means for rapidly attaching the silencer to the firearm barrel, and for rapidly detaching the silencer from it will benefit the firearm user by permitting him to utilize or not utilize the silencer at will, depending upon his shooting environment and desirability for compactness of the firearm versus the desirability of reduced report from the firearm. Although permanently-mounted silencers or silencers which are constructed integral with a firearm are available, not all situations call for use of a silencer. In particular, using a firearm in confined areas can be more difficult when the length of the firearm is increased by having a silencer attached to it. Therefore the inventors desire to provide firearm users with a reliable and convenient mechanism for quickly and securely attaching a silencer to a firearm and removing the silencer from the firearm so that a firearm user can decide on a moment's notice whether or not to use his/her silencer in a particular situation.

Further, it is desirable to be able to use a silencer in conjunction with another type of muzzle device for a firearm, such as a flash hider or a muzzle brake. A flash hider serves to manage expanding gases created by shooting a firearm in a manner that a visible fireball or flash from escaping burning gases is reduced in size and/or intensity compared to shooting the firearm without the flash hider in place. Flash hiders are more appropriately called "flash suppressors" because they do not entirely hide or eliminate muzzle flash. A muzzle brake serves to reduce recoil and/or muzzle rise in a firearm by directing some of the expanding gases released by shooting the firearm to surfaces ports of the muzzle brake that will tend to generally draw the firearm muzzle forward or downward, compared to what its route of travel would be without the muzzle brake attached. Providing such functionality in addition to the noise reduction associated with use of a silencer is considered optimal.

In the invention, a firearm silencer mount is provided that permits a firearm sound suppressor to be quickly attached to and detached from either a muzzle device or a barrel without a muzzle device if the muzzle end of the barrel is configured for use with the invented silencer mount. The mount facilitates mounting a silencer or sound suppressor to a muzzle device by using a plurality of both primary lugs and backup lugs. A muzzle device configured to accept the silencer can be affixed to the muzzle of a firearm barrel, or the muzzle of a firearm barrel can be machined or formed to have the structures necessary to mount the silencer to it. If a muzzle device is used, the muzzle device has axial slots to receive the primary lugs of the sound suppressor mount. The axial slots lead to sockets which permit the primary lugs to be rotated angularly several degrees with respect to the longitudinal axis of the firearm barrel in order to secure the silencer to the muzzle device. The muzzle device also has an annular groove which accepts the backup lugs and permits their rotation therein. The backup lugs can reach the annular groove by traveling through the aforementioned axial slots. This arrangement serves to interfere with the possible distal axial movement of the lugs with respect to the firearm barrel, thus preventing the sound suppressor from disengaging from the muzzle device during use.

When a silencer is mounted to a muzzle device using the invented mount as described in the prior paragraph and elsewhere in this document, the primary lugs firmly engage the sockets as the firearm silencer is rotated angularly with respect to its longitudinal bore. Such rotation causes an angled bearing face of the firearm sound suppressor to press against an angled bearing face of the muzzle device, applying a force thereto which tends to draw the primary lugs distally away from the firearm muzzle and causing them to lock in their sockets. The rotation occurs within screw threads of the silencer compression nut and threaded keyed back cap that gradually force the two angled bearing faces to approach and eventually contact each other. A series of detents on the firearm sound suppressor gives the user the feel of positive clicks as the sound suppressor is rotated, causing the two bearing faces to bear against each other and causing the primary lugs to be tightly and securely fixed in the radial grooves. This securely mounts the firearm sound suppressor to the muzzle device.

In the event that the primary lugs are bent, broken or destroyed, or otherwise fail to function, then any force which would tend to move the firearm sound suppressor distally away from the muzzle device will cause the backup lugs to engage the annular groove in which they rest, thereby preventing undesirable departure of the firearm sound suppressor from the muzzle device.

Even more simply described, the invented firearm sound suppressor mount uses a plurality of lugs on the proximal end of a firearm sound suppressor to firmly engage a muzzle device which is affixed to a firearm barrel. On the firearm sound suppressor, a plurality of lugs on a compression nut secure into sockets on the muzzle device, while opposed bearing faces of the sound suppressor and muzzle device firmly press against each other to achieve secure fitment of the sound suppressor to the muzzle device so that they can operate together as a unitary device. This system keeps the firearm sound suppressor from unscrewing or loosening with respect to the muzzle device under extreme vibration and through vast thermal changes.

DETAILED DESCRIPTION

Figure 1:
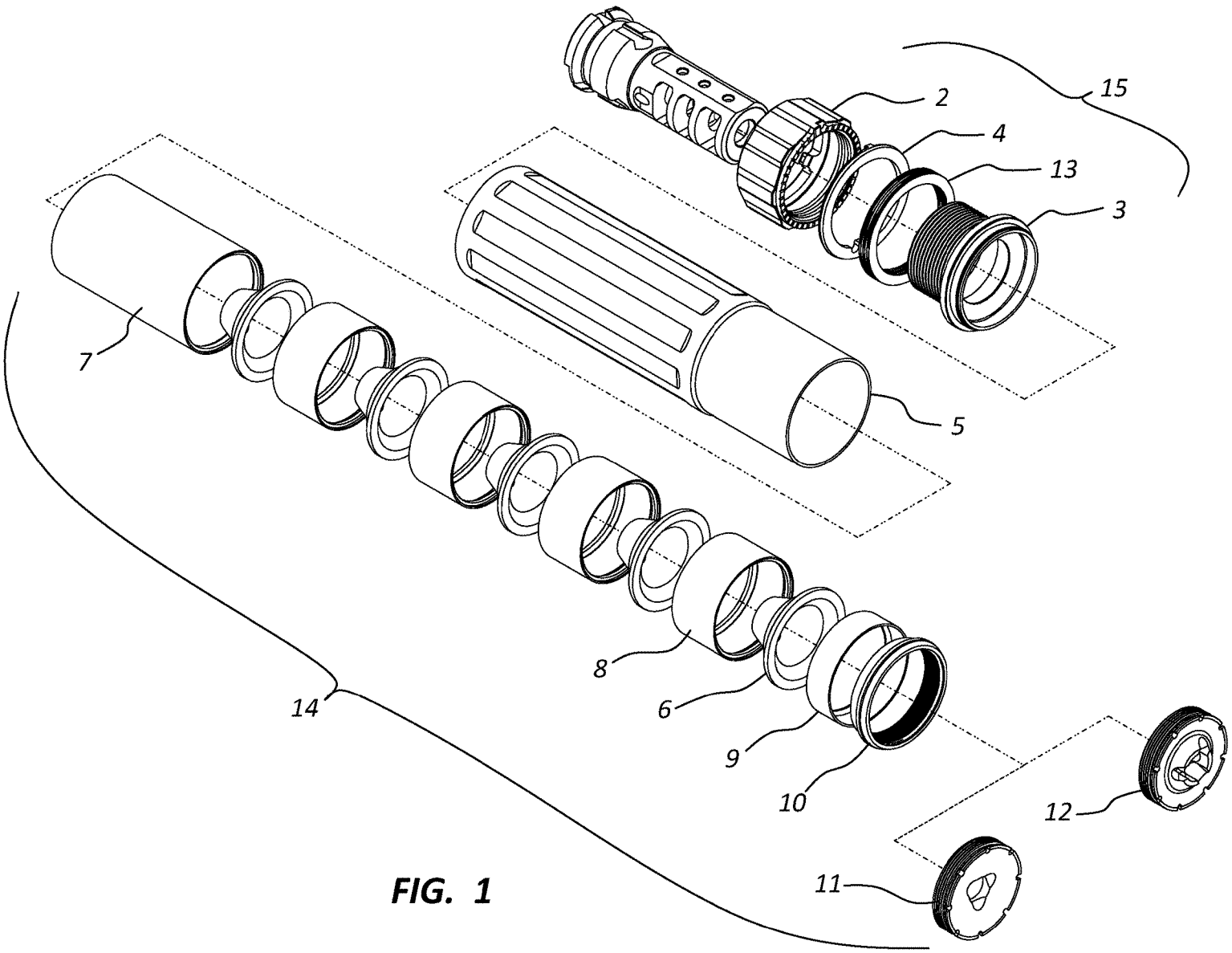
FIG. 1 depicts an example silencer and muzzle brake combination embodying concepts of the invented silencer mount.
Figure 2:
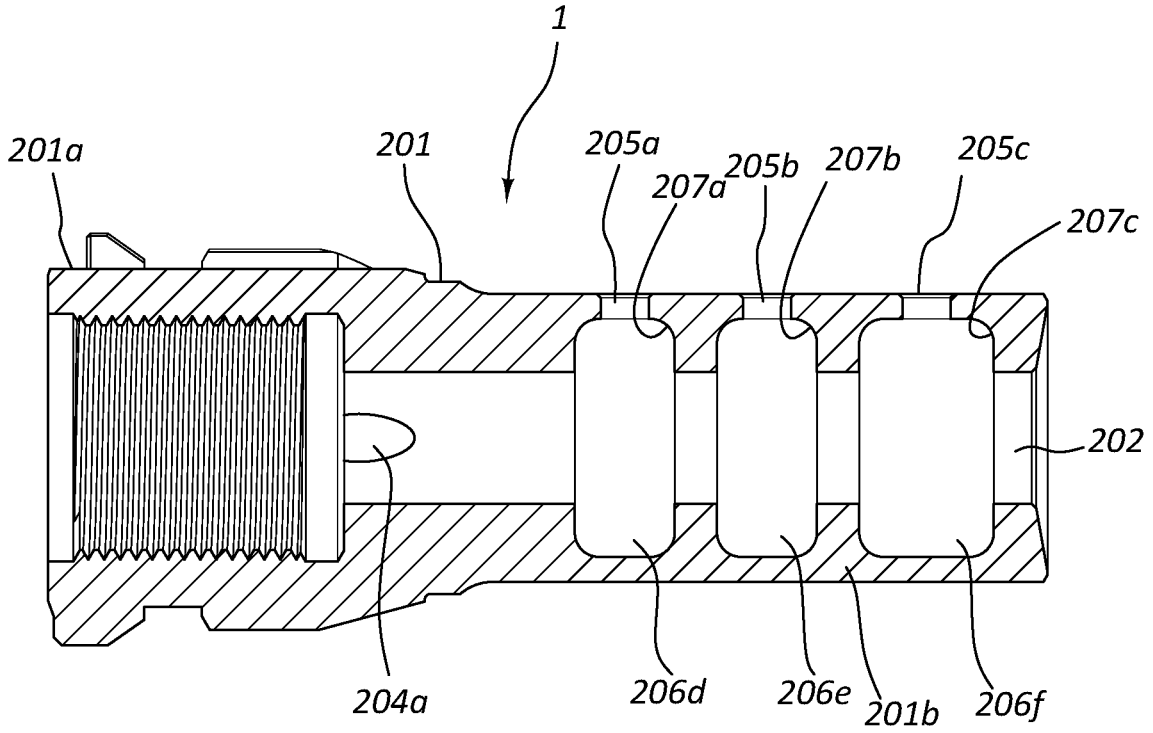
FIG. 2 depicts a side view of an example muzzle brake which can be used in conjunction with the invented silencer mount.
Figure 3:
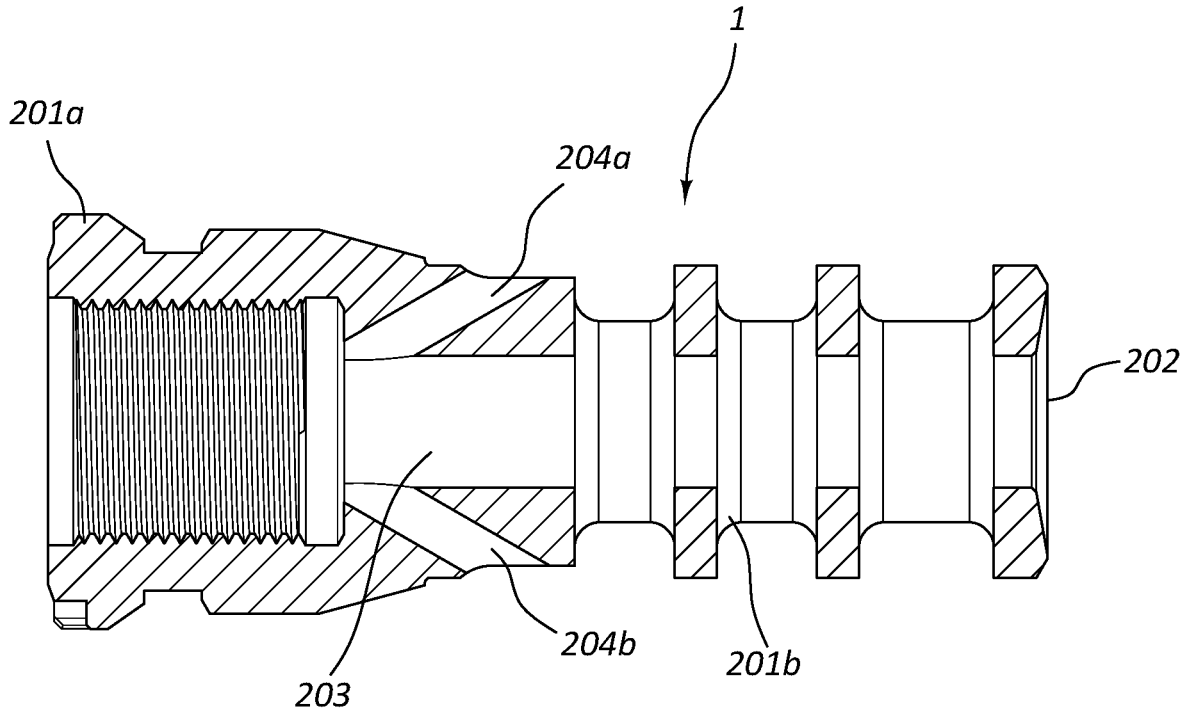
FIG. 3 depicts a bottom view of the muzzle brake of FIG. 2.
Figure 4:
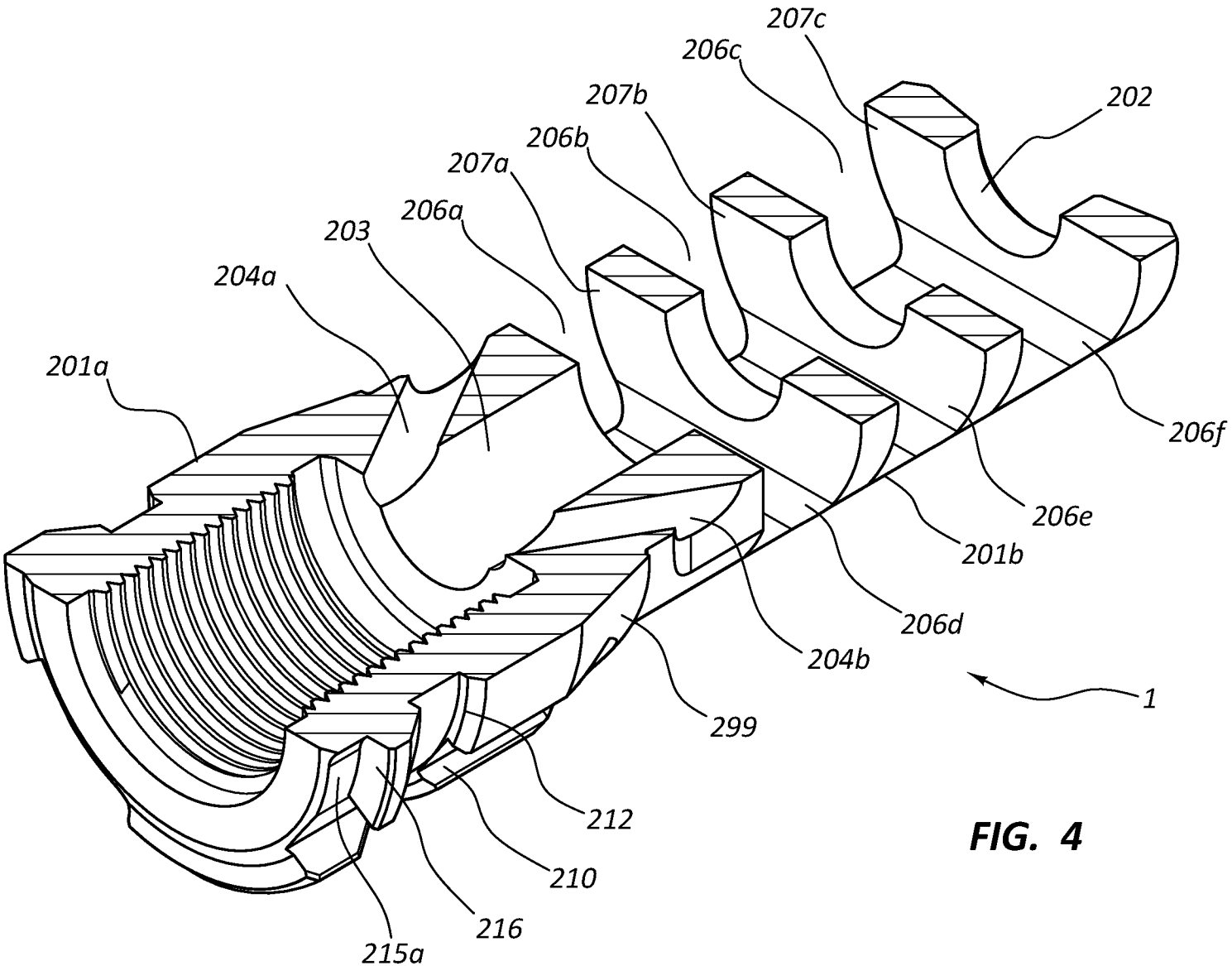
FIG. 4 depicts a longitudinal sectional view of the muzzle brake of FIG. 2.
Figure 7:
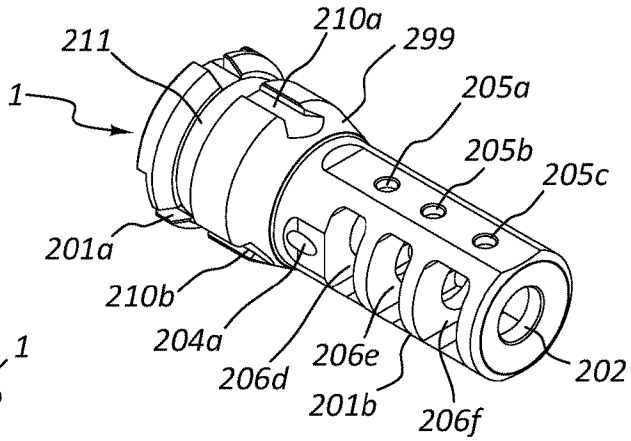
FIG. 7 depicts another perspective view of the muzzle brake of FIG. 2.
Figure 6:
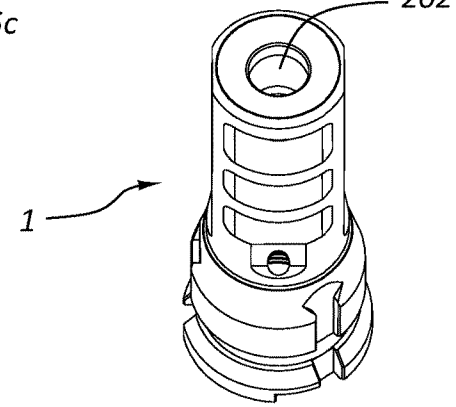
FIG. 6 depicts a perspective view of the muzzle brake of FIG. 2.
Figure 8:
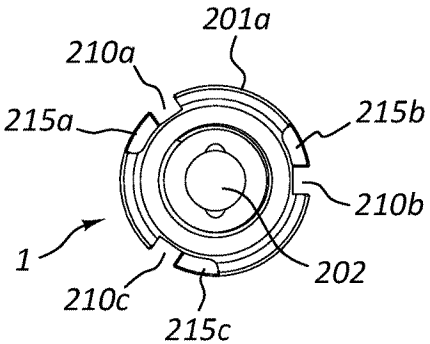
FIG. 8 depicts a proximal end view of the muzzle brake of FIG. 2.
Figure 9:
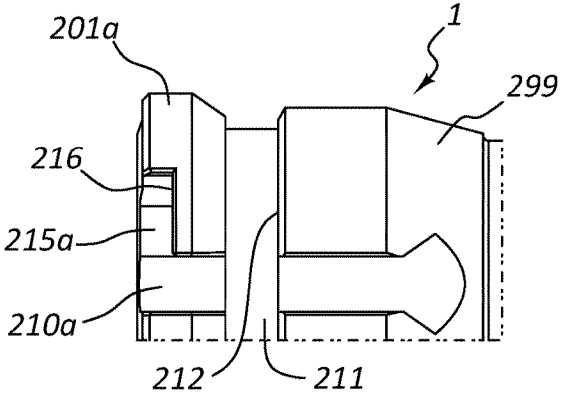
FIG. 9 depicts detail of the section "A" of the muzzle brake from FIG. 8.

Referring to the figures, an example implementation of the inventive concepts is depicted. In FIG. 1, a silencer mount system is depicted by showing an example silencer which can releaseably mount to an example muzzle brake, with the parts that achieve such releasably mounting depicted in that figure and in further figures described below. A muzzle brake 1 is shown that can be mounted to the muzzle end of a firearm barrel. The muzzle brake includes structures which facilitate a silencer 14 (in this example consisting of parts numbered as 2 through 13) being releasably mounted to it.

The silencer attaches to the muzzle brake or other muzzle device or specially-configured firearm barrel. The silencer is an elongate device with a longitudinal axis that generally aligns with the bore of a firearm barrel to which it attaches. The proximal end of the silencer attaches to the muzzle device, and the distal end of the silencer is free. Both a bullet and expanding gases from a firearm barrel enter the proximal end of the silencer and later exit the distal end of the silencer from where the bullet travels to its target.

The example silencer includes a lugged and threaded compression nut 2 which operates with threaded keyed back cap 3 to compress wave spring 13 against a detent 4 to create a rotationally securable and releasable lugged silencer attachment mechanism 15. The rotationally securable and releasable lugged silencer attachment mechanism 15 serves to attach the silencer to the muzzle device or brake 1 and to detach it therefrom using the principles explained in the SUMMARY section above.

The example silencer 14 also has a tube 5 which attaches to the rotationally securable and releasable lugged silencer attachment mechanism 15. The tube 5 serves to house a series of baffles 6 which provide a sound reduction function in the assembled silencer. The baffles 6 and tube 5 are assembled with a large spacer 7 oriented toward the proximal end of the silencer, a series of small spacers 8 in between the baffles 6, and a final spacer 9 oriented toward the distal end of the silencer. Generally, each baffle 6 has a spacer (7, 8 or 9) on its proximal and distal sides.

The example silencer 14 also has a front cap 10 at its distal end which completes its structural assembly. The front cap 10 has an internal opening for receiving therein a silencer escaping gas treatment mechanism 11 or its alternative embodiment 12. The escaping gas treatment mechanisms 11 and 12 tend to retain expanding gases from discharge of a firearm within the silencer 14 to provide a sound reduction function. The escaping gas treatment mechanisms 11 and 12 can also provide a flash reduction function, and are described in greater detail below.

Referring to FIGS. 2, 3, 4, 5, 6, 7, 8, 9, 5A, 8A and 9A, an example muzzle device 1 is depicted, including a variation represented by the figures ending with the letter "A". This muzzle device is a muzzle brake which can be utilized to reduce recoil and muzzle rise of the firearm to which it is attached when the firearm is discharged. The muzzle device 1 will typically be attached to the muzzle end of a firearm barrel by use of threads. Other attachment is possible, such as pinning, welding, or other mechanical fitment. Alternatively, a muzzle device can be machined into the muzzle of the firearm itself, if desired.

The example muzzle device 1 depicted in the figures provides a function not found in other muzzle devices. That function is not necessary to operation of the invented suppressor mount, but it enhances operation of the overall firearm system. The example muzzle device 1 is a muzzle brake with vent holes that create a gas chopping effect to hide muzzle flash. Traditional muzzle brakes allow expanding and burning gases from a rifle barrel to be vented to the side of the muzzle brake. The expanding gases set up a standing wave which provides somewhat optimal conditions for burning of powder residue, which results in a fireball around the muzzle brake when a firearm to which it is attached is fired. This fireball is known as muzzle flash.

The muzzle brake depicted in the figures has a body with a plurality of ports or gills through which expanding gas can exit to a region outside of the muzzle brake referred to herein as the flash region. In order to reduce muzzle flash, the invented muzzle brake has a small chamber area ahead of the rifle muzzle. The chamber area collects expanding and burning gases from the rifle muzzle, and builds up pressure as the bullet moves through a constricted bore of the muzzle brake ahead of the chamber area. A pair of vent tunnels extend from the chamber area to the exterior of the muzzle brake in an angled fashion so that gas in the chamber area passes through the vent tunnels to the flash region before the main body of burning and expanding gases reaches the flash region. Gas from the vent tunnels creates a chopping effect in the flash region in order to prevent a standing wave from being established in the flash region, thus creating sub-optimal conditions for powder burn. The sub-optimal conditions result in the expanding gases burning to a lesser extent than if the chopping effect were not used. Consequently the brake creates less flash than a brake without the unique chamber and vent tunnels.

The muzzle brake 1 of FIGS. 2, 3, 4, 5, 6, 7, 8, 9, 5A, 8A and 9A includes an elongate body 201 which is expected to be generally aligned with the longitudinal axis of the barrel of a firearm to which it attaches, and which is expected to be generally aligned with the longitudinal axis of a silencer which may be attached to the muzzle device 1. The elongate body 201 includes a threaded attachment section 201*a* at the proximal end of the muzzle device 1 that has threads for attaching to the threaded muzzle of a firearm barrel. The elongate body 201 has a vented section 201*b* which can include a plurality of gas vents that permit expanding gases from a fired round of ammunition to escape in directions other than along the longitudinal axis of the muzzle device 1, such as horizontally or vertically. A bore 202 extends through the length of the muzzle device 1 and is sized to permit a bullet to travel therethrough without contacting the muzzle device 1.

The muzzle brake 1 has a chamber 203 which is distal to the attachment section and is in gas communication with the bore 202. When a round of ammunition is fired, the bullet travels from the firearm muzzle through the chamber 203 then down the bore 202 and out the distal end of the muzzle brake 1. The chamber 203 has a greater radial dimension than the bore 202. When the bullet reaches the bore 202, expanding gases build up in the chamber 203. Those gases are then directed laterally outward from the longitudinal axis of the muzzle brake 1, and forward from the firearm muzzle and from the attachment section 201*a*, by a pair of vent tunnels 204*a* and 204*b*. Gas which escapes the chamber 203 through the vent tunnels 204*a* and 204*b* reaches the flash region outside the periphery of the muzzle brake 1. As a bullet travels from the chamber 203 down the bore 202, it passes a plurality of vertical gas ports 205*a*, 205*b* and 205*c*, and a plurality of horizontal gas ports 206*a*, 206*b*, 206*c*, 206*d*, 206*e* and 206*f*. Gas exits the muzzle brake 1 through the vertical gas ports 205*a*, 205*b* and 205*c*, and gas exits the horizontal gas ports 206*a*, 206*b*, 206*c*, 206*d*, 206*e* and 206*f* to the flash region outside the periphery of the muzzle brake 1. Gas from the vent tunnels 204*a* and 204*b* reaches the flash region before gas from the vertical gas ports or horizontal gas ports reaches the flash region. By arriving at the flash region first, gas from the vent tunnels creates a chopping effect in the flash region. This chopping effect prevents gas from the horizontal and vertical gas ports from establishing a standing wave in the flash region. If a standing wave is established in the flash region, then burn conditions in the flash region will be relatively optimized and discharge gases from discharge of the firearm to which the muzzle brake 1 is attached will burn brightly. But the chopping effect provided by gas which the vent tunnels directs from the chamber 203 to the flash region and which arrives in the flash region prior to gas from the vertical and horizontal vent holes arriving in the flash region prevents a standing wave from being established in the flash region, thus creating sub-optimal conditions for powder burn in order to reduce muzzle flash. In this example, the vent tunnels are cylindrical, the vertical gas ports are round holes and the horizontal gas ports are rectangular with radiused corners, but they could be of any desired shape.

At least some of the gas ports such as horizontal gas ports 206*a*, 206*b*, 206*d*, 206*e* and 206*f* can include a push wall 207*a*, 207*b* and 207*c* against which escaping gas can press. By pressing forward against a push wall, the gas from a firearm discharge will tend to counteract some of the rearward recoil of shooting the firearm, making the firearm more controllable and more pleasant to shoot. In addition, the vertical gas ports will tend to push the firearm barrel downward to counteract muzzle rise.

In the example muzzle brake 1, a plurality of axial slots 210*a*, 210*b* and 210*c* facilitate axial movement of a silencer 14 (including parts 2-13) with respect to the muzzle brake 1 by permitting lugs on the silencer 14 to move along the slots 210*a*, 210*b* and 210*c*. The axial slots 210*a*, 210*b* and 210*c* lead first to an annular groove 211 intersecting the slots at an axially medial location. Secondary or backup lugs (discussed below) on a back cap 3 of the silencer 14 can travel axially through the axial slots 210*a*, 210*b* and 210*c* from the distal end of the muzzle brake 1 toward the proximal end of the muzzle brake 1 to the annular groove 211, where they can turn and travel angularly in the annular groove. Thus, both primary and backup lugs can simultaneously move axially within the slots. A distal groove wall 212 retains the backup lugs in place in the annular groove so that the silencer 14 is retained on the muzzle brake 1.

The axial slots 210*a*, 210*b* and 210*c* also lead to a plurality of retention sockets 215*a*, 215*b* and 215*c*. Primary lugs on a compression nut 2 of the silencer 14 can travel down the axial slots to the retention sockets. The primary lugs can then turn into the retention sockets and be retained there. The primary lugs turn into the retention sockets by rotation of the silencer 14 with respect to the muzzle brake 1. Thus, while the primary lugs are retained stationary within the retention sockets, the backup lugs can move angularly within the annular groove 211. The retention sockets have a distal wall 216 against which the primary lugs bear to keep the silencer secured to the muzzle device. The retention sockets on the muzzle device in combination with the primary lugs on the silencer are designed to secure the silencer on the muzzle device when the firearm to which these parts are attached is discharged. The backup lugs in their annular groove serve as a backup or secondary securement mechanism to retain the silencer on the muzzle device in case the primary lugs are broken or otherwise fail. This system prevents the sound suppressor from disengaging with the muzzle device during use.

Figure 5:
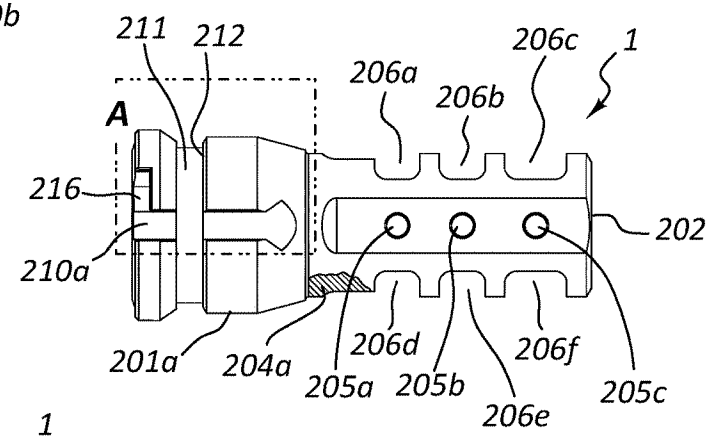
FIG. 5 depicts a top view of the muzzle brake of FIG. 2.
Figure 5A:
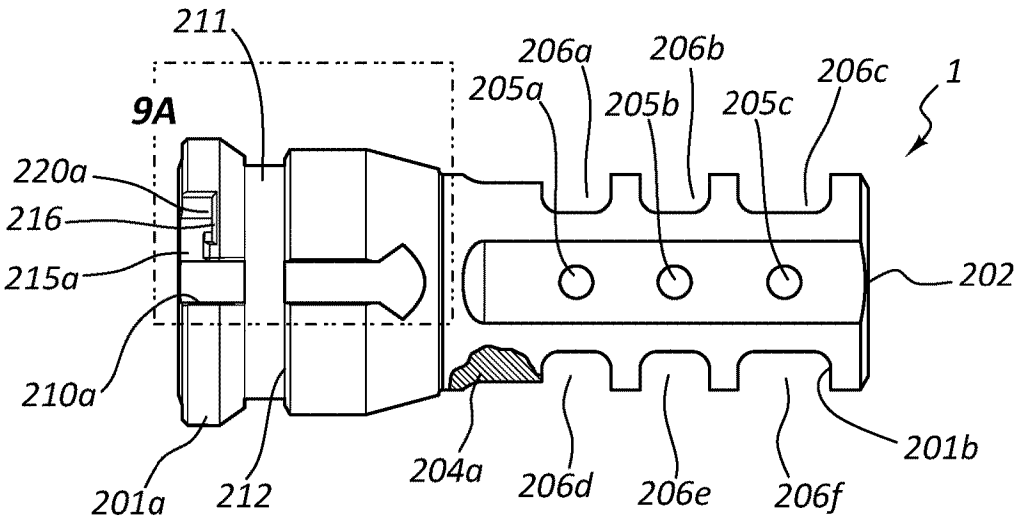
FIGS. 5A, 8A and 9A depict structures corresponding to those shown in FIGS. 5, 8 and 9, but with the addition of primary lug pockets as an additional securement mechanism.
Figure 8A:
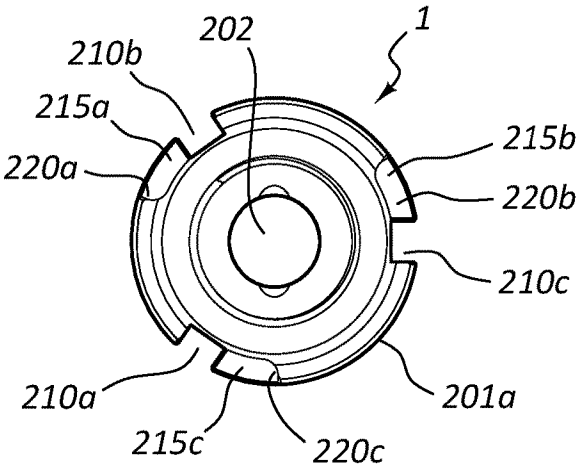
Figure 9A:
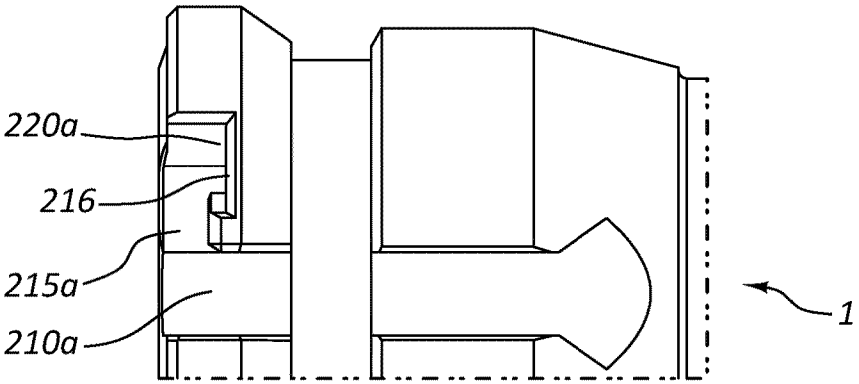
Figure 10C:
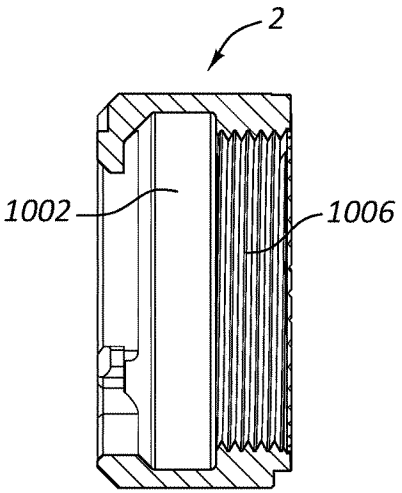
FIGS. 10A, 10B, 10C, 10D, 10E, 10F and 10G, depict an example compression nut which carries primary lugs for retaining a silencer on a muzzle device in the invented silencer mount.
Figure 10B:
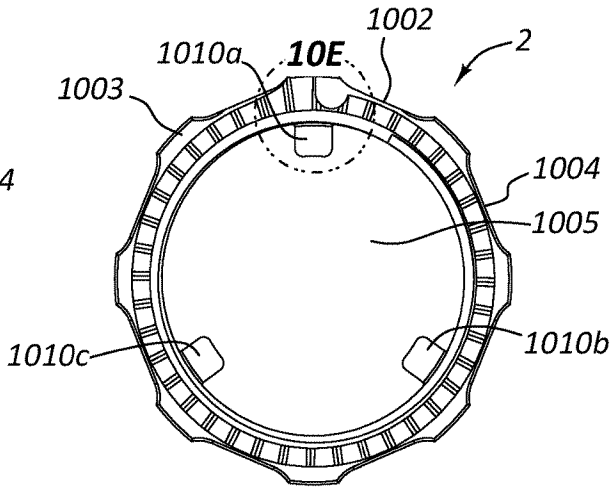
Figure 10A:
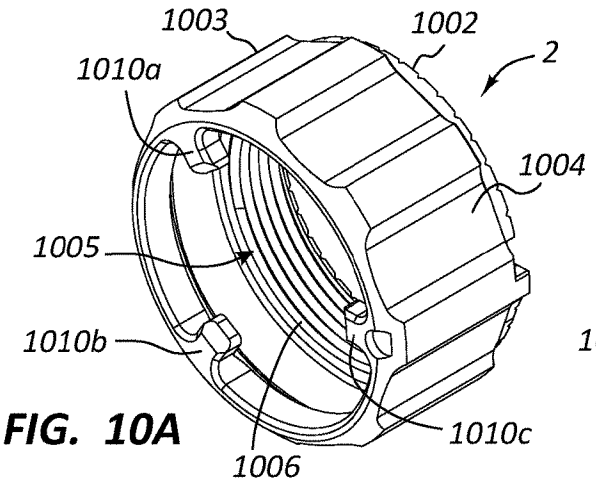
Figure 10G:
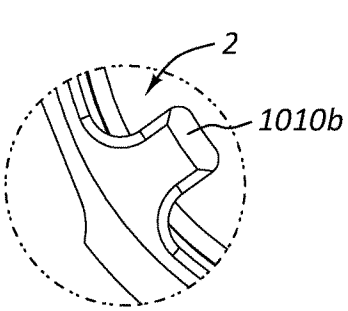
Figure 10F:
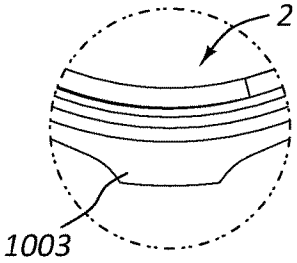
Figure 10E:
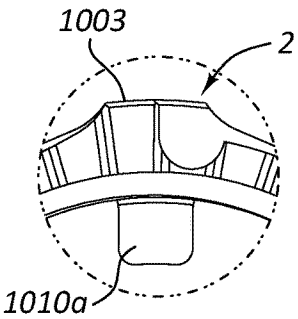
Figure 10D:
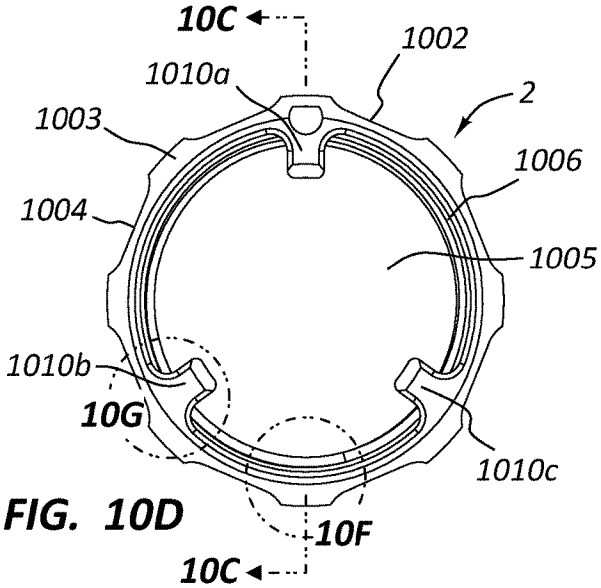
Figure 11A:
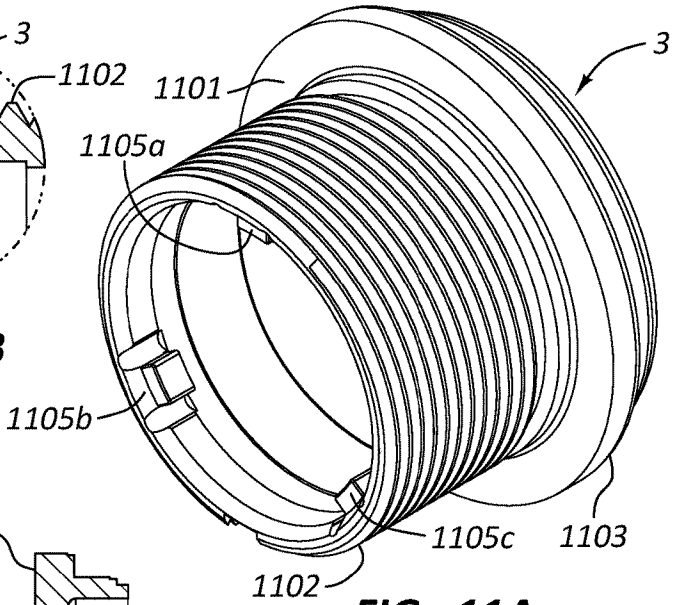
FIGS. 11A, 11B, 11C, 11D, 11E and 11F depict an example keyed back cap which may be used in the invented silencer mount.
Figure 11B:
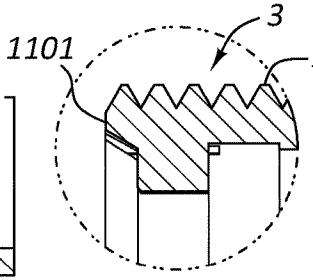
Figure 11C:
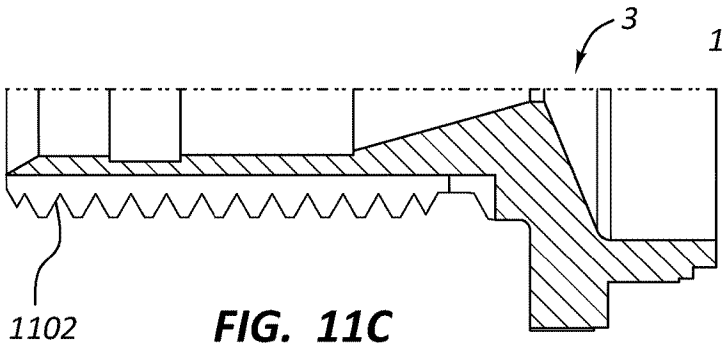
Figure 11E:
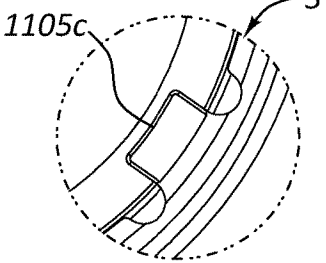
Figure 11F:
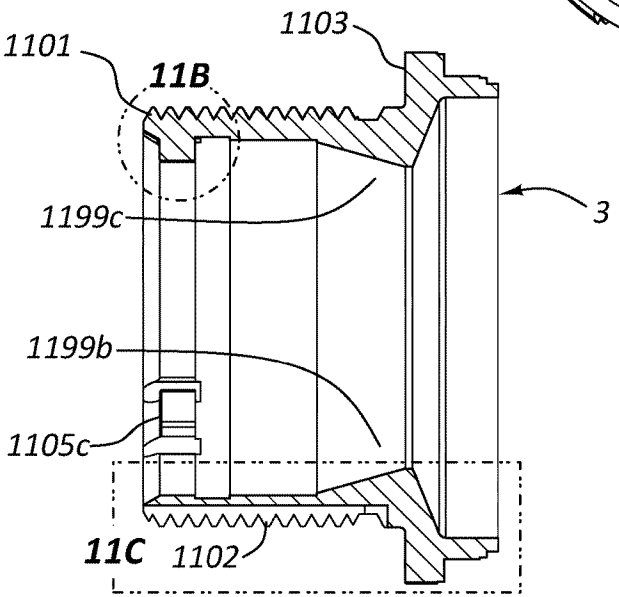
Figure 11D:
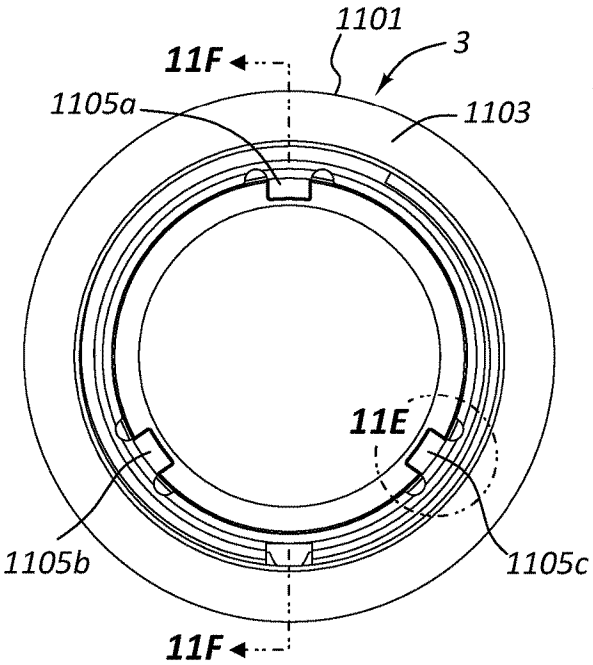
Figure 12C:
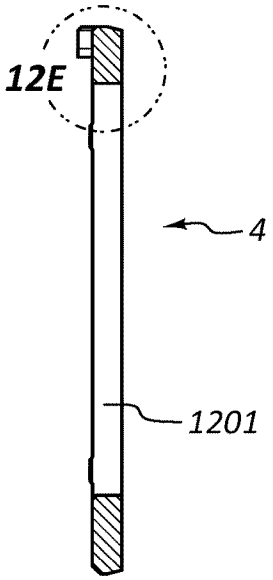
FIGS. 12A, 12B, 12C, 12D, 12E and 12F depict an example detent ring 4 which may be used in the invented silencer mount.
Figure 12B:
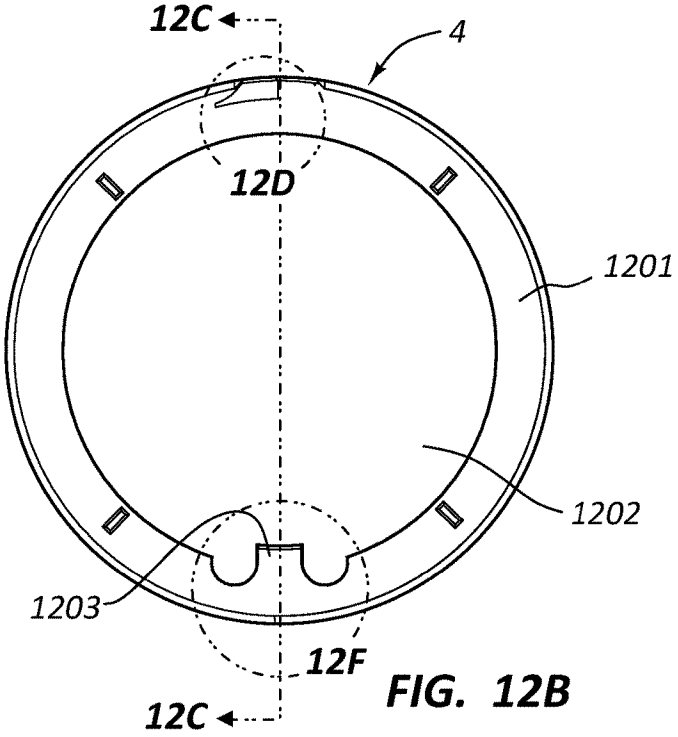
Figure 12F:
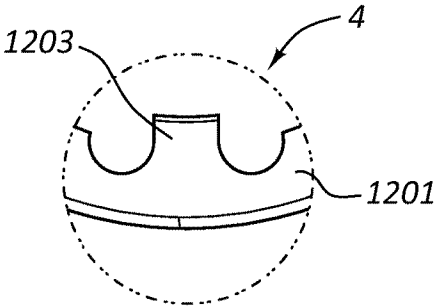
Figure 12E:
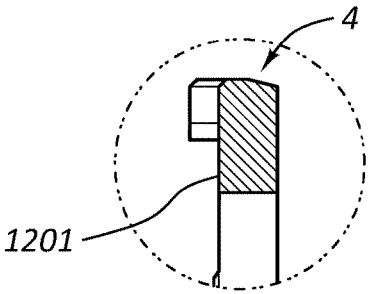
Figure 12A:
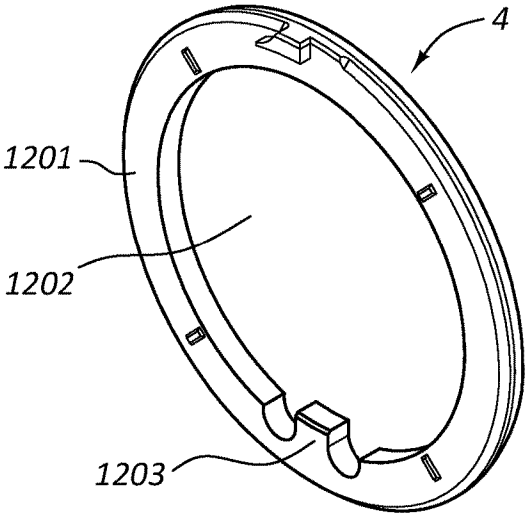
Figure 12D:
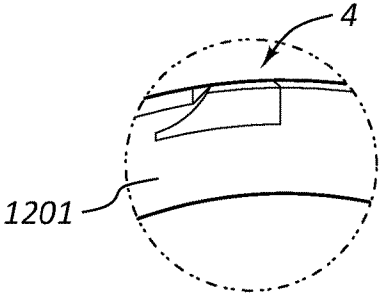
Figure 13A:
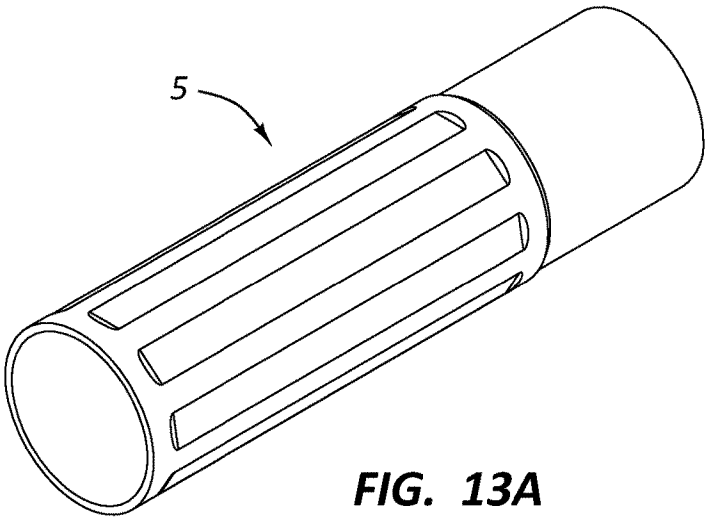
FIGS. 13A, 13B, 13C, 13D, 13E and 13F depict a tube which can be used with the example silencer.
Figure 13B:
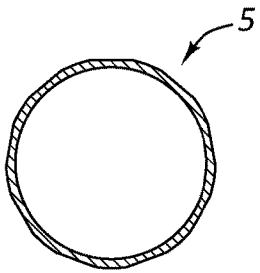
Figure 13C:
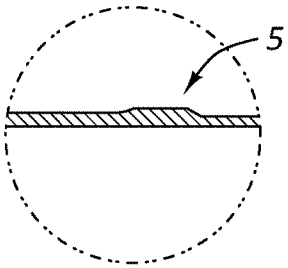
Figure 13D:
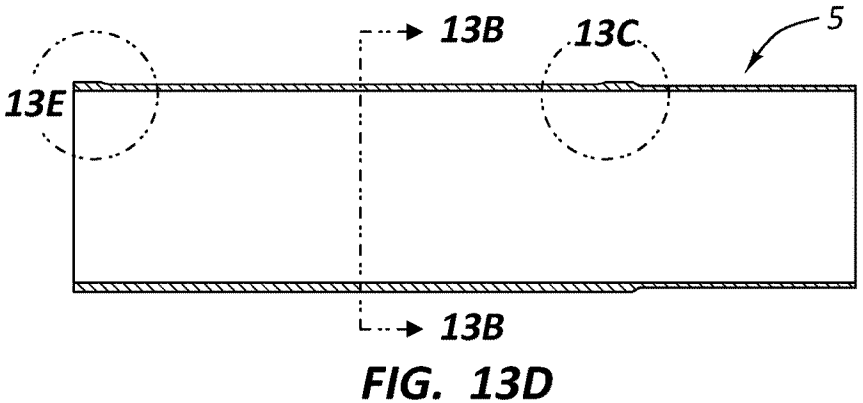
Figure 13E:
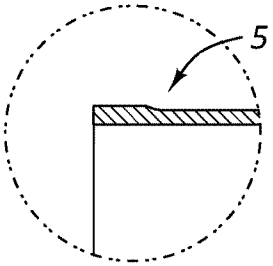
Figure 13F:
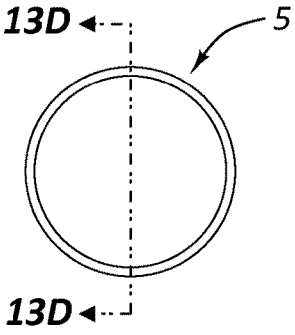
Figure 14C:
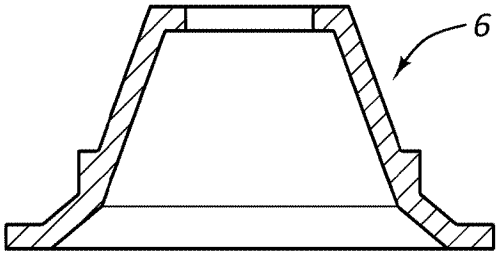
FIGS. 14A, 14B, 14C, 14D and 14E depict the baffles used in the example silencer.
Figure 14E:
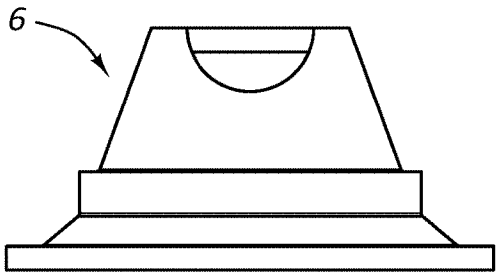
Figure 14B:
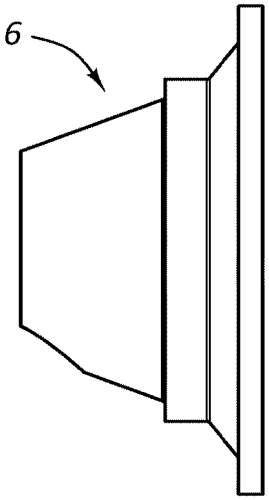
Figure 14D:
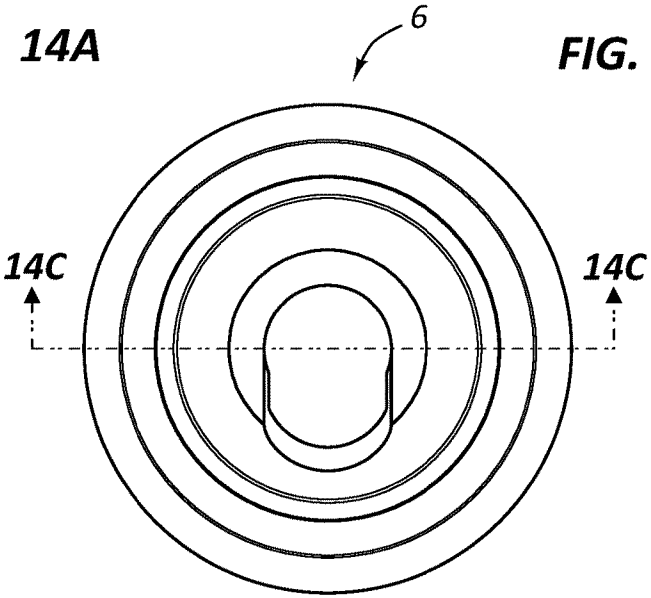
Figure 14A:
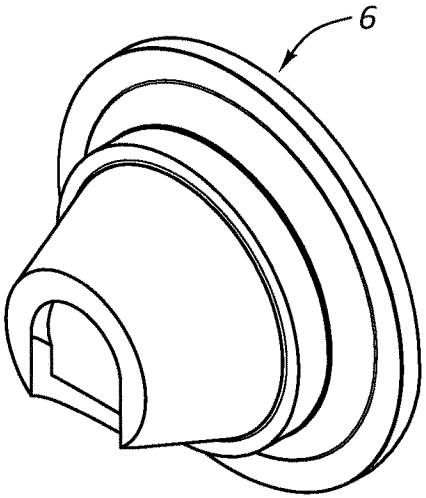
Figure 15A:
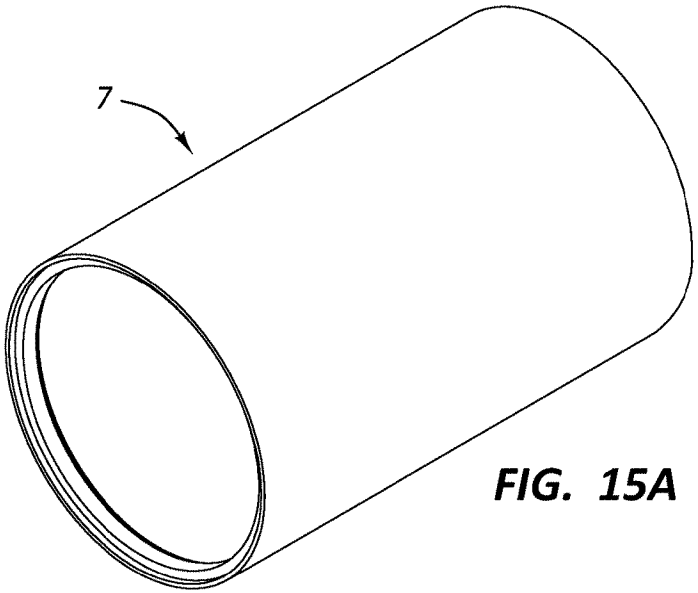
FIGS. 15A, 15B, 15C and 15D depict a tube used in the example silencer.
Figure 15B:
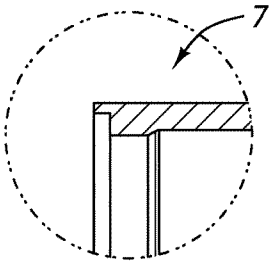
Figure 15C:
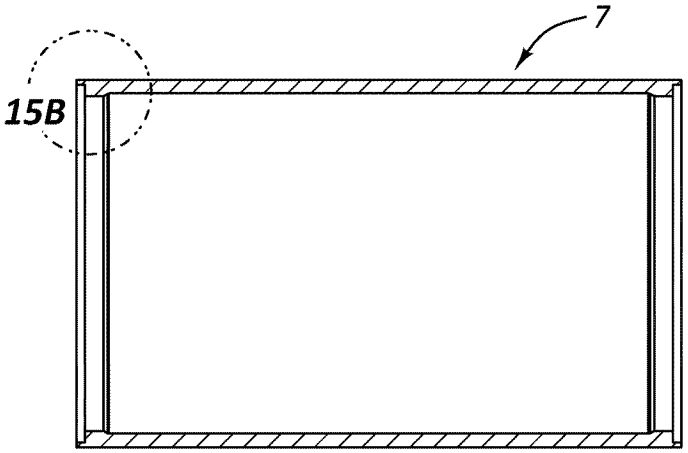
Figure 15D:
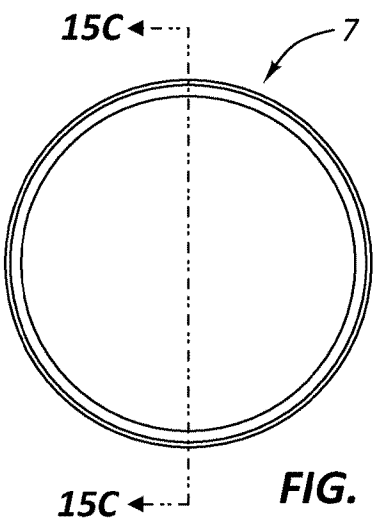
Figure 16A:
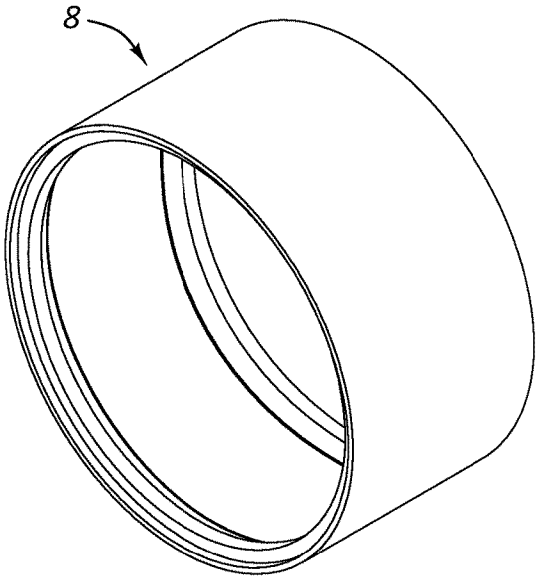
FIGS. 16A, 16B, 16C and 16D depict a spacer used in the example silencer.
Figure 16B:
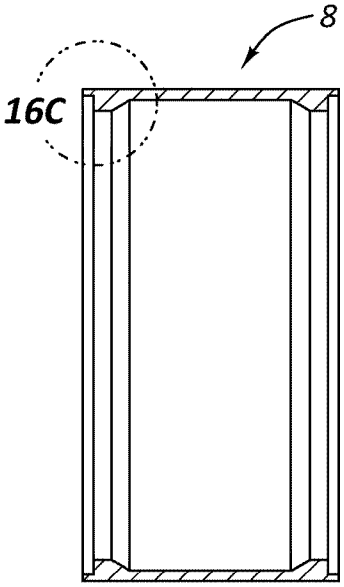
Figure 16C:
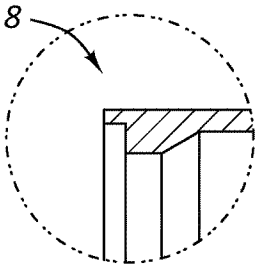
Figure 16D:
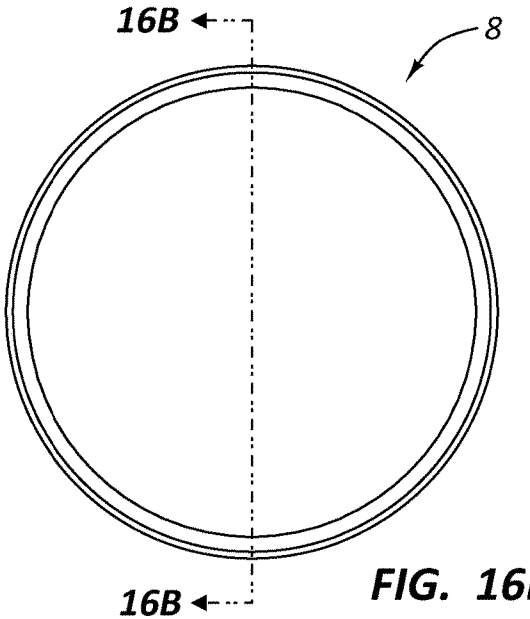
Figure 17A:
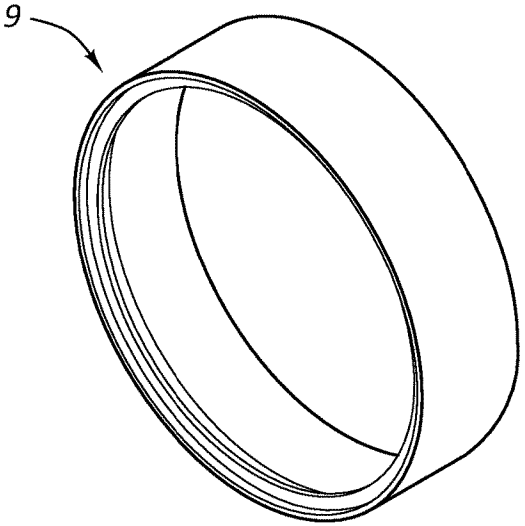
FIGS. 17A, 17B, 17C and 17D depict a final spacer used in the example silencer.
Figure 17B:
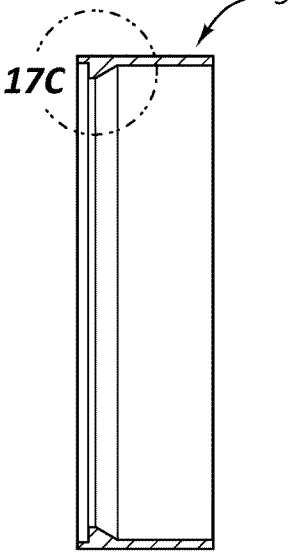
Figure 17C:
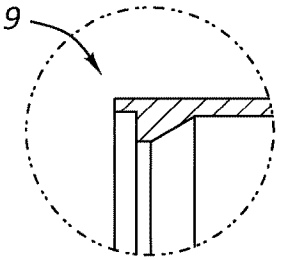
Figure 17D:
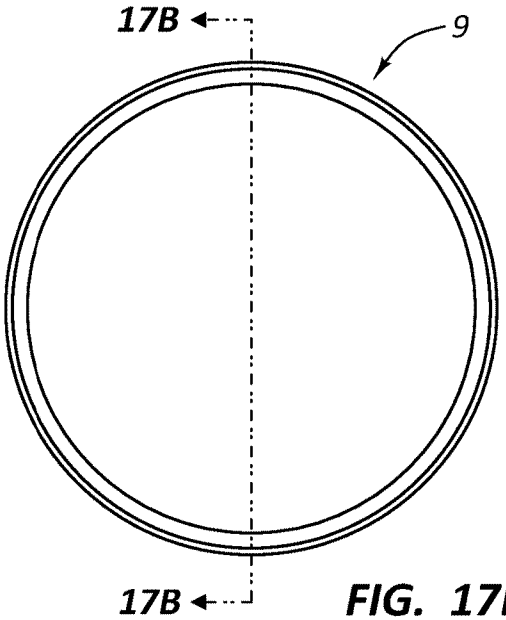
Figure 18A:
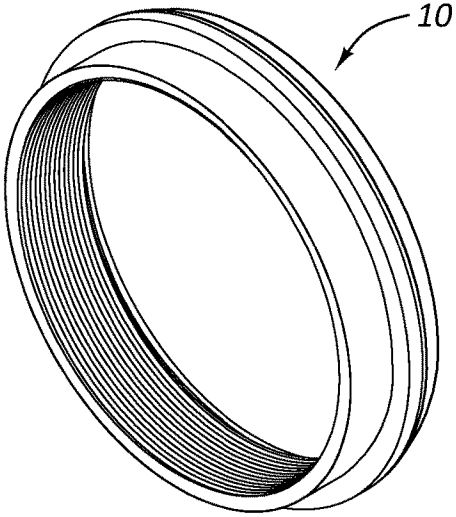
FIGS. 18A, 18B, 18C and 18D depict a threaded front cap used in the example silencer.
Figure 18B:
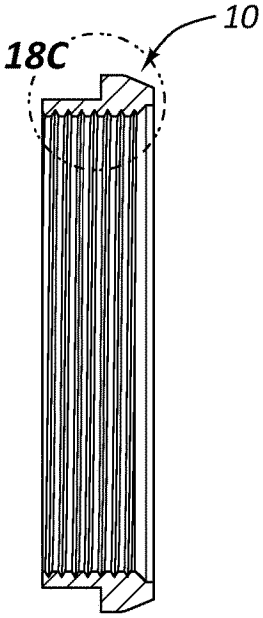
Figure 18C:
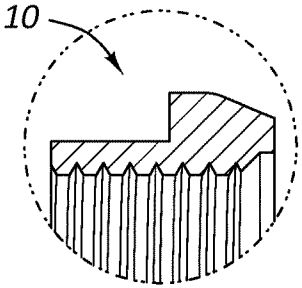
Figure 18D:
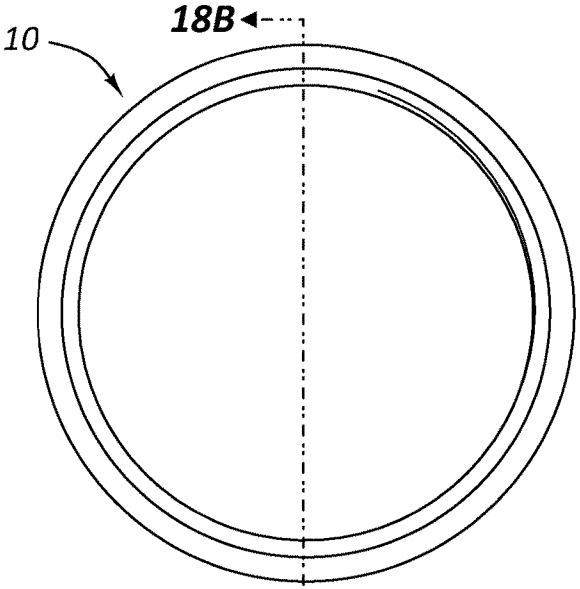
Figure 19A:
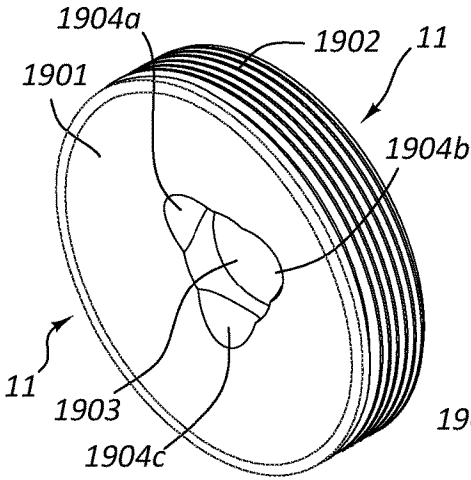
FIGS. 19A, 19B, 19C, 19D, 19E, 19F, 19G and 19H depict a silencer escaping gas treatment mechanism with bullet aperture.
Figure 19B:
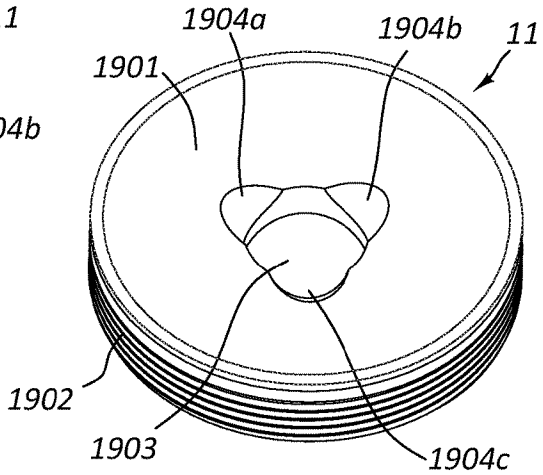
Figure 19C:
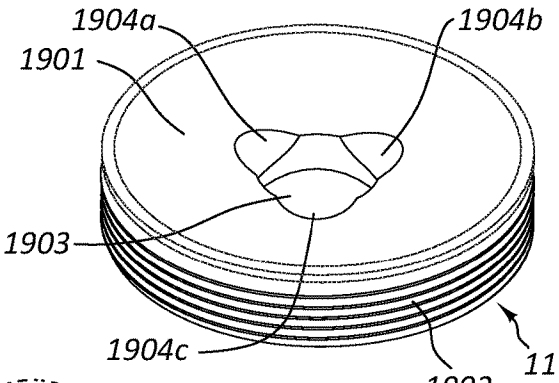
Figure 19F:
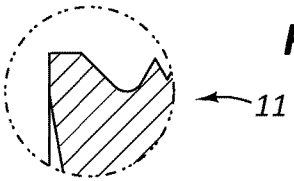
Figure 19G:
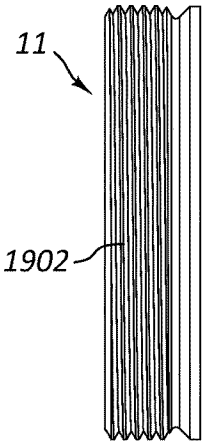
Figure 19H:
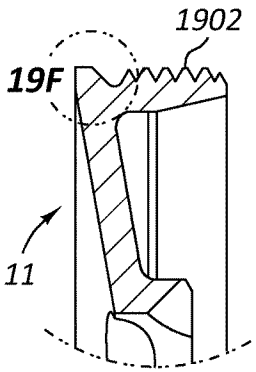
Figure 19E:
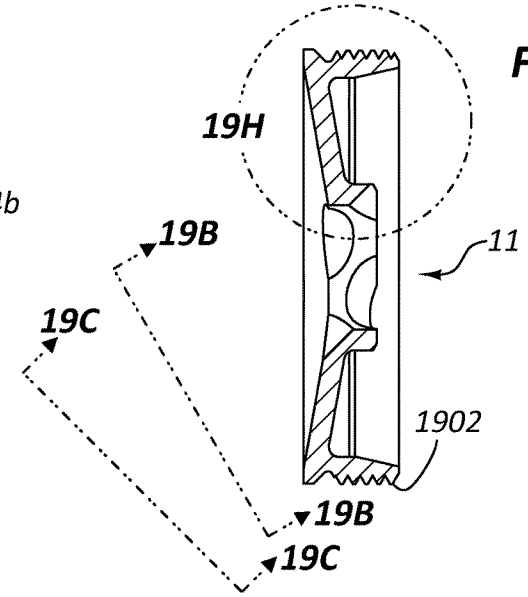
Figure 19D:
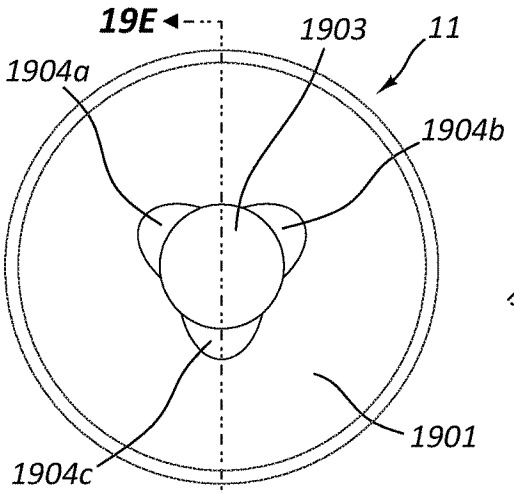
Figure 20C:
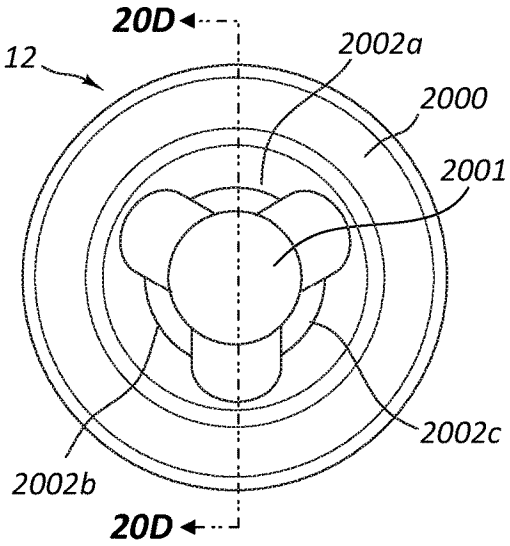
FIGS. 20A, 20B, 20C, 20D, 20E, 20F and 20G depict an alternative silencer escaping gas treatment mechanism with bullet aperture.
Figure 20B:
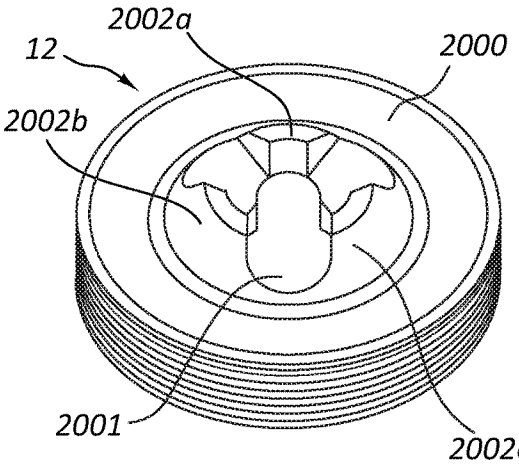
Figure 20A:
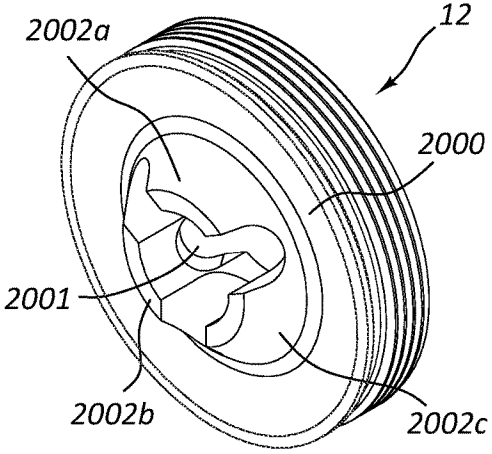
Figure 20G:
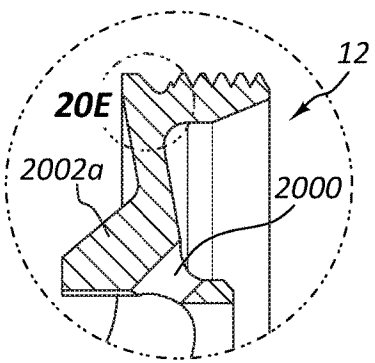
Figure 20F:
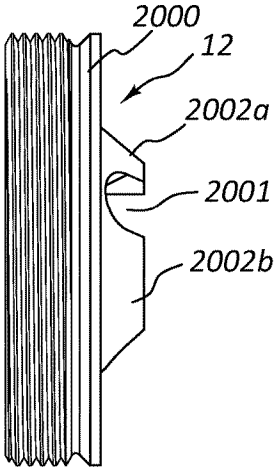
Figure 20E:
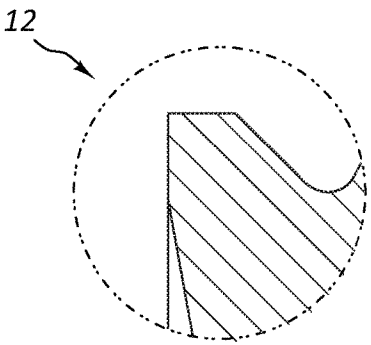
Figure 20D:
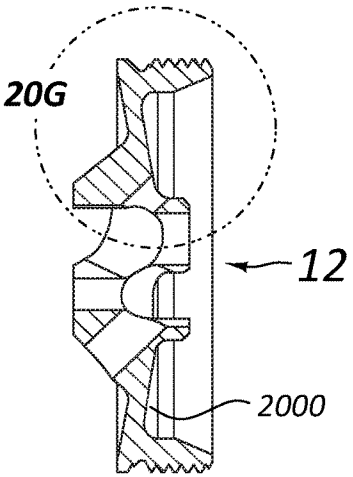

Referring to FIGS. 5A, 8A and 9A, as an additional securement, the primary lug retention sockets 215*a*, 215*b* and 215*c* can also be configured to include a pocket 220*a*, 220*b* and 220*c* into which the primary lugs can drop. Once the primary lugs drop into the pockets 220*a*, 220*b* and 220*c*, they are held in place by a fish hook edge which prevents their release unless the silencer is manually pressed axially toward the firearm muzzle and with the silencer simultaneously being turned in a disengaging direction.

Referring to FIGS. 10A, 10B, 10C, 10D, 10E, 10F and 10G, the compression nut 2 is depicted in greater detail. The exterior periphery of the compression nut 1002 has a series of semi-undulated projections 1003 and troughs 1004 to facilitate gripping of the compression nut 2 by a human hand in order to rotate it in either direction. The compression nut 2 has an interior recess 1005 for receiving a keyed back cap 3 therein. At least a portion of the interior of the compression nut 2 has threads 1006 for mating with similar threads on the exterior of keyed back cap 3. The compression nut 2 has a plurality of primary lugs 1010*a*, 1010*b*, and 1010*c* for use in achieving secure attachment to a muzzle device 1.

Referring to FIGS. 11A, 11B, 11C, 11D, 11E and 11F an example keyed back cap 3 which may be used in the invented silencer mount is depicted. The keyed back cap 3 has a body 1101 which has a threaded portion 1102 on its outer periphery. The threads serve to cause relative movement of the keyed back cap 3 with respect to the compression nut 2 when one is turned relative to the other. The keyed back cap 3 has a stop wall 1103 which will abut the compression nut 2 to prevent over-rotation of the compression nut 2 with respect to the keyed back cap 3. The keyed back cap 3 also has a plurality of backup lugs 1105*a*, 1105*b* and 1105*c* for placement in the annular groove of the muzzle device 1 to provide a backup securement of the silencer with respect to the muzzle device in case of failure of the primary lugs on the compression nut.

Referring to FIGS. 12A, 12B, 12C, 12D, 12E and 12F an example detent ring 4 which may be used in the invented silencer mount is depicted. The detent ring 4 has a body 1201 which defines an inner receptacle 1202 through which the keyed back cap 3 may project in order to allow the keyed back cap 3 to be assembled with the compression nut 2 having the detent ring 4 therebetween. The detent ring includes a single lug 1203 which indexes with the keyed back cap.

FIGS. 13A, 13B, 13C, 13D, 13E and 13F depict the tube 5 of the example silencer 14. FIGS. 14A, 14B, 14C, 14D, and 14E depict the baffles 6 used in the example silencer 14. FIGS. 15A, 15B, 15C, and 15D depict a tube 7 used in the example silencer 14. FIGS. 16A, 16B, 16C and 16D depict a spacer 8 used in the example silencer 14. FIGS. 17A, 17B, 17C and 17D depict a final spacer 9 used in the example silencer 14. FIGS. 18A, 18B, 18C and 18D depict a threaded front cap 10 used in the example silencer 14. These components are assembled according to traditional techniques.

FIGS. 19A, 19B, 19C, 19D, 19E, 19F, 19G and 19H depict a silencer escaping gas treatment mechanism with bullet aperture 11. The escaping gas treatment mechanism 11 takes the form of a circular plate 1901 with threads 1902 on its outer periphery for attachment to the threaded front cap 10. The circular plate 1901 has a bullet aperture 1903 centrally located on it and sized to permit a bullet to pass therethrough without contact being made by the bullet with the plate. The bullet aperture 1903 is formed in a clover shape with three clover leaf troughs 1904*a*, 1904*b* and 1904*c* being formed on the plate 1901 in the region of the bullet aperture 1903. The clover leaf troughs 1904*a*, 1904*b* and 1904*c* cause escaping gases to be directed outwardly from the bullet aperture in order to reduce flash. The plate 1901 is concave on its distal side. The bullet aperture can include clover leaf troughs on the proximal side of the plate as well.

FIGS. 20A, 20B, 20C, 20D, 20E, 20F and 20G depict an alternative silencer escaping gas treatment mechanism 12 with bullet aperture. The escaping gas treatment mechanism 12 has a body 2000 with a bullet aperture 2001 in its center. The escaping gas treatment mechanism body 2000 has plurality of short prongs 2002*a*, 2002*b*, and 2002*c* located around the bullet aperture 2001 and angled toward the bullet aperture 2001. The prongs can either project outwardly from the distal end of the silencer or inwardly toward the interior of the silencer. On the body 2000 opposite each prong is an angled slot 2005*a*, 2005*b* and 2005*c*. The combination of angled prongs and opposing angled slots manages gas escaping from the silencer to minimize flash. That combination of prongs and slots diverts the expanding gases from between the interior prongs and across the bore line to the space between the distal prongs on the exterior of the escaping gas treatment mechanism, resulting in reduced flash.

Figure 21C:
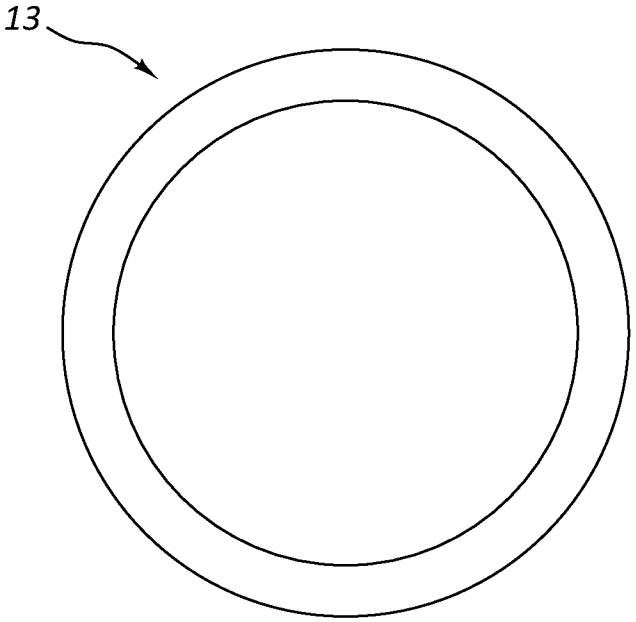
FIGS. 21A, 21B and 21C depict a wave spring that can be used in some embodiments of the invention.
Figure 21B:
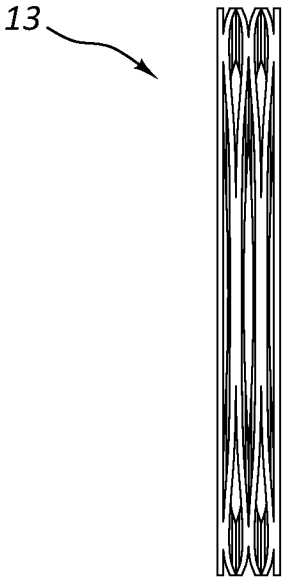
Figure 21A:
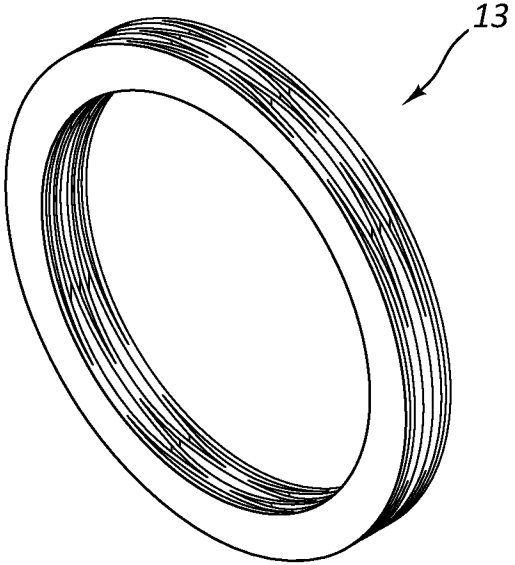

FIGS. 21A, 21B and 21C depict a wave spring 13 that can be used to bias the detent ring 4 axially against the compression nut 2 with respect to the threaded keyed back cap 3 in order to spring load the detent ring 4.

When the invented silencer mount is constructed according to the example depicted herein, the primary and backup lugs on a silencer with their corresponding axial slots, annular groove and lug retention sockets on muzzle device are configured to ensure that the silencer can be installed on the muzzle device in one way only, so that improper installation is impossible. Installation is achieved by a user gripping the body of the silencer and turning it, so use of tools is avoided. Delicate pins and levers are avoided, for a sturdy and durable product. When the primary lugs enter their lug retention sockets, further turning of the silencer with respect to the muzzle device draws the silencer toward the muzzle device causing an angled bearing face on the silencer (such as 1199*a* and 1199*b* in FIG. 11F) to be forced against an angled bearing face of the muzzle device (such as 299 in FIGS. 6, 7, 8 and 9) to cause a very tight fit between the silencer and the muzzle device. The detent ring and wave spring serve to assist in keeping tension between threads of the compression nut and back cap as tightening occurs. The detent ring provides the user with the feel of positive clicks as the silencer is rotated toward or away from the muzzle device. In addition, once the silencer is removed from the muzzle device by rotating it, the lugs align themselves in their start position so that when the silencer is removed it is immediately ready for re-installation with no preparation step needed. In the event that the primary lugs are bent, broken or destroyed, or otherwise fail to function, then any force which would tend to move the firearm sound suppressor distally away from the muzzle device will cause the backup lugs to likely bear against the distal groove wall of the annular groove, thereby preventing undesirable departure of the firearm sound suppressor from the muzzle device.

What is claimed is:

1. An apparatus comprising:

a firearm comprising a barrel having a distal structure;

wherein said distal structure comprises:

a body extending along a longitudinal axis, said body having a proximal end and a distal end;

an axial slot formed into said body;

a socket extending angularly from said axial slot; and, an annular groove intersecting said axial slot;

an attachment comprising:

a back cap;

a compression nut threaded upon said back cap;

wherein said compression nut comprises a radially inwardly extending primary lug;

wherein said back cap comprises a radially inwardly extending secondary lug;

wherein said primary lug and said secondary lug can simultaneously move axially within said axial slot; and, wherein said secondary lug can move angularly within said annular groove while said primary lug is retained stationary within said socket.

2. The apparatus of claim 1, wherein said socket extends angularly from an axially proximal location on said axial slot, and wherein said annular groove intersects said axial slot at an axially medial location.

3. The apparatus of claim 1, which further comprises:

a detent ring between said compression nut and said back cap; and, a wave spring between said detent ring and said back cap, wherein said wave spring biases said detent ring axially toward said compression nut.

4. The apparatus of claim 1, which further comprises a pocket extending axially distally into a distal wall of said socket; and wherein said primary lug moves axially distally to engage said pocket when said primary lug fully engages said socket.

5. The apparatus of claim 1, which further comprises:

a plurality of said axial slot angularly spaced apart on said distal structure;

a plurality of said primary lug angularly spaced apart on said compression nut; and, a plurality of said secondary lug angularly spaced apart on said back cap.

6. The apparatus of claim 5, wherein said plurality of said axial slot, said plurality of said primary lug, and said plurality of said secondary lug are in angular alignment with one another.

7. The apparatus of claim 1, which further comprises:

said distal structure further comprising a first angled surface;

said attachment further comprising a second angled surface; and said first angled surface and said second angled surface bearing against one another while said primary lug engages said socket and said back cap rotates with respect to said compression nut.

8. The apparatus of claim 1, wherein said attachment further comprises:

a mechanism body having a bullet aperture;

a plurality of prongs angled toward said bullet aperture;

a separate slot opposite each of said plurality of prongs;

whereby a combination of said plurality of prongs and said separate slot diverts expanding gases to reduce flash during firing of said firearm.

9. The apparatus of claim 1, wherein said distal structure comprises a muzzle brake, and wherein said attachment comprises a silencer.

* * * * *